US010385498B2

(12) United States Patent
Kim et al.

(10) Patent No.: US 10,385,498 B2
(45) Date of Patent: Aug. 20, 2019

(54) WASHING MACHINE AND A METHOD FOR OPERATING SAME

(71) Applicant: AMOTECH CO., LTD., Incheon (KR)

(72) Inventors: Byung Soo Kim, Anyang-si (KR); Hyung Hwan Ko, Anseong-si (KR); Hak Rok Kim, Daegu (KR); Se Ki Lee, Incheon (KR)

(73) Assignee: AMOTECH CO., LTD. (KR)

( * ) Notice: Subject to any disclaimer, the term of this patent is extended or adjusted under 35 U.S.C. 154(b) by 317 days.

(21) Appl. No.: 15/313,291

(22) PCT Filed: Jun. 15, 2015

(86) PCT No.: PCT/KR2015/006003
§ 371 (c)(1),
(2) Date: Nov. 22, 2016

(87) PCT Pub. No.: WO2016/003086
PCT Pub. Date: Jan. 7, 2016

(65) Prior Publication Data

US 2017/0204551 A1 Jul. 20, 2017

(30) Foreign Application Priority Data

Jun. 30, 2014 (KR) ..... 10-2014-0080935

(51) Int. Cl.
*D06F 37/30* (2006.01)
*D06F 37/40* (2006.01)

(52) U.S. Cl.
CPC ..... *D06F 37/40* (2013.01); *D06F 37/304* (2013.01)

(58) Field of Classification Search
CPC ..... D06F 37/304; D06F 37/40
USPC ..... 68/134
See application file for complete search history.

(56) References Cited

U.S. PATENT DOCUMENTS

2007/0152521 A1* 7/2007 Park ..... D06F 37/304 310/67 R
2012/0304704 A1* 12/2012 Ponnaganti ..... D06F 37/40 68/140

FOREIGN PATENT DOCUMENTS

| | | |
|---|---|---|
| JP | 2006043153 | 2/2006 |
| KR | 100434192 | 7/2004 |
| KR | 100548310 | 2/2006 |
| KR | 100890891 | 4/2009 |
| KR | 100925428 | 11/2009 |
| KR | 101345326 | 12/2013 |

OTHER PUBLICATIONS

International Search Report—PCT/KR2015/006003 dated Aug. 27, 2015.

* cited by examiner

*Primary Examiner* — Levon J Shahinian
(74) *Attorney, Agent, or Firm* — Cantor Colburn LLP

(57) ABSTRACT

Provided is a washing machine including: a washing tub connected with an outer rotor and an outer shaft; a pulsator connected with an inner rotor and an inner shaft; and a planetary gear set mounted between the inner rotor and the pulsator and between the outer rotor and the washing tub, to thus reduce a rotational force of the inner shaft, wherein the rotational force of the inner rotor is transmitted to the washing tub by the planetary gear set when a load is applied to the pulsator at the time of an initial start of the inner rotor, to thus lower a starting current and lower an end current at a time when the inner rotor is stopped, to thereby reduce power consumption.

2 Claims, 8 Drawing Sheets

WASHING MACHINE AND A METHOD FOR OPERATING SAME

TECHNICAL FIELD

The present invention relates to a washing machine that may drive a washing tub and a pulsator independently, to thus implement a dual-power, and a method of operating the same.

BACKGROUND ART

As disclosed in Korean Patent Registration Publication No. 10-0548310 (published on Oct. 24, 2006), a conventional washing machine includes: an outer case forming an outer shape; an outer tub which is supported on an inside of the outer case and receives wash water therein; an inner tub which is rotatably accommodated in an inside of the outer tub and is used for both washing and dehydrating; a pulsator which is mounted relatively rotatably in an inside of the inner tub, to thus form a washing water flow; a drive motor for generating a driving force for rotating the inner tub and the pulsator; an inner tub rotating shaft which receives the driving force of the drive motor thereby rotating the inner tub; a pulsator rotating shaft which receives the driving force of the drive motor thereby rotating the pulsator; a sun gear which is connected to the drive motor and is connected to the pulsator rotating shaft; a plurality of planetary gears which are simultaneously engaged with both the sun gear and a ring gear; a carrier supporting the planetary gears so as to be rotated and revolved; and a clutch spring for controlling the rotation of the inner tub and the pulsator during washing or dehydrating.

The conventional washing machine as described above has a planetary gear set including the sun gear, the ring gear, the planetary gears and the carrier, and reduces the rotational force of the drive motor, to then be transferred to the pulsator and the inner tub, and operates the clutch spring to selectively transmit power to the pulsator and the inner tub, to thus rotate only the pulsator or to thus rotate both the pulsator and the inner tub simultaneously.

However, since the conventional washing machine has a structure in which the pulsator and the inner tub can rotate only in an identical direction, the pulsator and the inner tub cannot be rotated in opposite directions to each other, to thus cause a problem that it is impossible to implement dual power.

Technical Problem

To solve the above problems or defects, it is an object of the present invention to provide a washing machine capable of independently driving a pulsator and a washing tub, to thus implement a dual-power to thereby form a variety of water flow patterns, and a method of operating the same.

It is another object of the present invention to provide a washing machine capable of lowering a starting current during an initial operation of an inner rotor or an outer rotor to reduce power consumption, and a method of operating the same.

It is another object of the present invention to provide a washing machine capable of reducing an end current when stopping a pulsator, stopping a washing tub, or changing a rotating direction, thereby reducing power consumption, and a method of operating the same.

Technical Solution

To accomplish the above and other objects of the present invention, according to an aspect of the present invention, there is provided a washing machine comprising: a washing tub connected with an outer rotor and an outer shaft; a pulsator connected with an inner rotor and an inner shaft; and a planetary gear set mounted between the inner rotor and the pulsator and between the outer rotor and the washing tub, to thus reduce a rotational force of the inner shaft, wherein the rotational force of the inner rotor is transmitted to the washing tub by the planetary gear set when a load is applied to the pulsator at the time of an initial start of the inner rotor.

Preferably but not necessarily, the inner shaft comprises: a first inner shaft connected to the inner rotor; and a second inner shaft connected to the pulsator, and the outer shaft comprises: a first outer shaft connected to the outer rotor; and a second outer shaft connected to the washing tub.

Preferably but not necessarily, the planetary gear set comprises: a ring gear that connects between the first outer shaft and the second outer shaft; a sun gear coupled to the first inner shaft; a planetary gear meshed with an outer surface of the sun gear and an inner surface of the ring gear; and a carrier rotatably supported by the planetary gear and connected to the second inner shaft.

Preferably but not necessarily, when the inner rotor is stopped, an electromagnetic brake of the outer rotor is released, and the inner rotor is stopped when the inner rotor is rotated in a no-load state, to thereby lower an end current.

According to another aspect of the present invention, there is provided a method of operating a washing machine, the method comprising the steps of: rotating an inner rotor in a clockwise (CW) direction; transmitting a rotational force of the inner rotor to a washing tub and an outer rotor by a planetary gear set when a load is applied to a pulsator; detecting an RPM (Round Per Minute) of the outer rotor and operating an electromagnetic brake for the outer rotor when the RPM of the outer rotor is equal to or higher than a set value; adjusting an RPM of the inner rotor according to the RPM of the outer rotor; and stopping the inner rotor for driving the pulsator in a reverse direction.

Preferably but not necessarily, the method further comprises a step of rotating the outer rotor in a counterclockwise (CCW) direction if the RPM of the outer rotor is equal to or lower than a set value or the outer rotor is not rotated.

Preferably but not necessarily, the step of adjusting the RPM of the inner rotor comprises increasing the RPM of the inner rotor in correspondence to a reduction ratio of 5:1, 3:1 or 4:1 of the planetary gear set so as to maintain the rotational speed of the pulsator when the outer rotor is rotated.

Preferably but not necessarily, the RPM of the inner rotor is adjusted according to the number of rotations of the pulsator.

Preferably but not necessarily, the step of stopping the inner rotor comprises: releasing the electromagnetic brake of the outer rotor to lower the end current; transmitting the rotational force of the inner rotor to the washing tub in place of the pulsator loaded by the planetary gear set; and stopping the inner rotor.

Advantageous Effects

As described above, in the washing machine of the present invention, the pulsator and the inner rotor are mutually connected, and the washing tub and the outer rotor are mutually connected, to thus independently drive the pulsator and the washing tub, to thereby implement a dual-power and form a variety of water flow patterns.

In addition, in the washing machine of the present invention, when a load is applied to the pulsator during initially driving the inner rotor or the outer rotor, the rotational force of the inner rotor or the outer rotor is transmitted to the washing tub by the planetary gear set, to thus lower a starting current to thereby reduce power consumption.

In addition, in the washing machine of the present invention, when the pulsator is stopped, the washing tub is stopped, or the rotating direction is changed, the electromagnetic brake of the outer rotor or the inner rotor is released so that the inner rotor is stopped in a state where the inner rotor or the outer rotor is rotated in a no-load condition, to thus lower an end current and reduce power consumption.

BEST MODE

Figure 1:
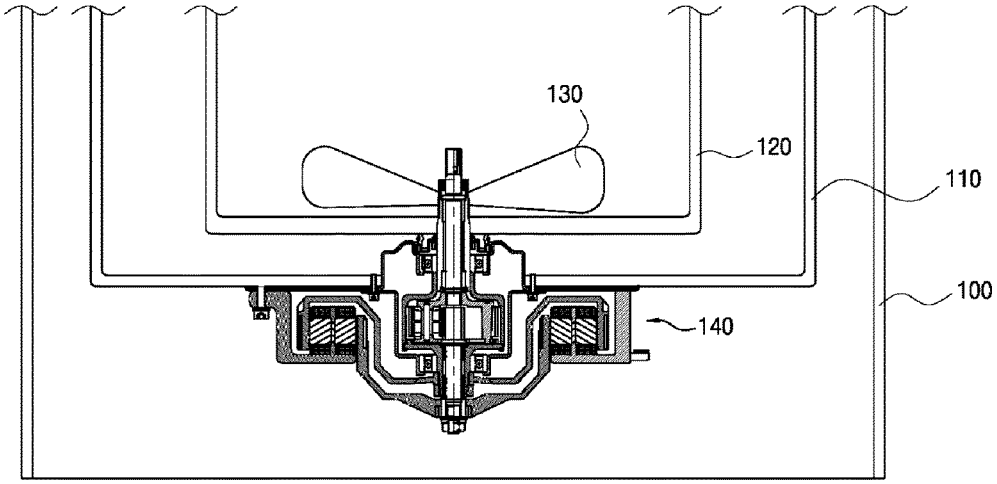
FIG. 1 is a cross-sectional view of a washing machine according to a first embodiment of the present invention.

Hereinafter, embodiments of the present invention will be described in detail with reference to the accompanying drawings. In the process, the size and shape of the components illustrated in the drawings may be shown exaggerated for convenience and clarity of explanation. Further, by considering the configuration and operation of the present invention the specifically defined terms may be changed according to user's or operator's intention, or the custom. Definitions of these terms herein need to be made based on the contents across the whole application.

Figure 2:
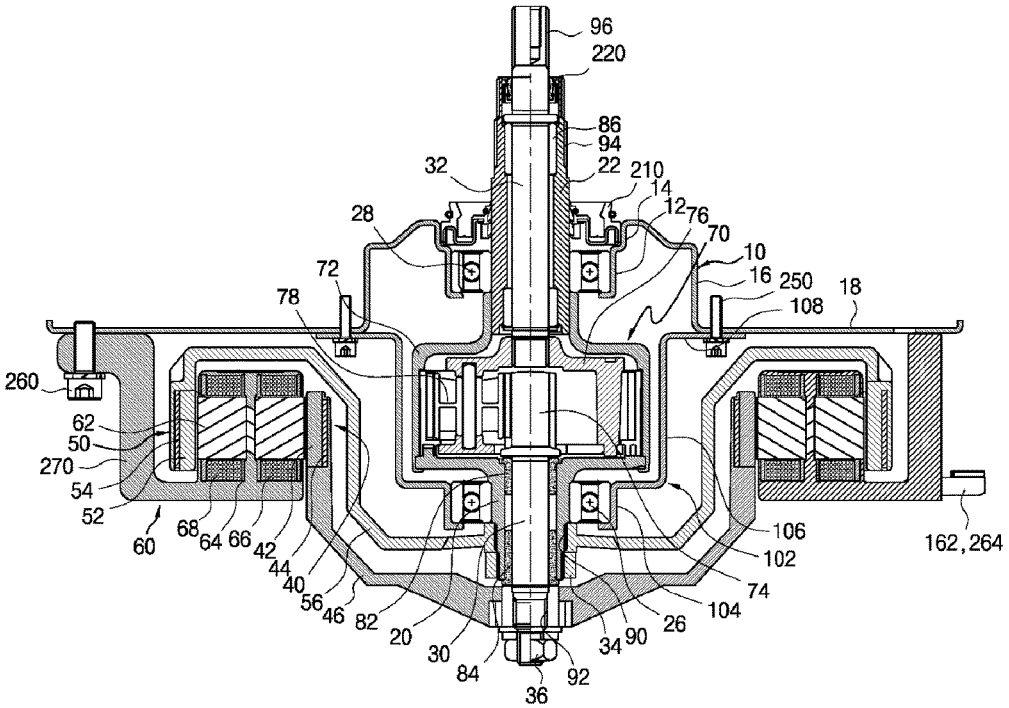
FIG. 2 is a cross-sectional view of a washing machine motor according to the first embodiment of the present invention.

FIG. 1 is a cross-sectional view of a washing machine according to a first embodiment of the present invention, and FIG. 2 is a cross-sectional view of a washing machine motor according to the first embodiment of the present invention.

Referring to FIGS. 1 and 2, a washing machine according to the first embodiment of the present invention includes: a case 100 forming an outer appearance; an outer tub 110 which is disposed in an inside of the case 100 and accommodating washing water; a washing tub 120 which is rotatably disposed inside the outer tub 110 to perform washing and dehydrating; a pulsator 130 which is rotatably disposed inside the washing tub 120 to form washing water flows; and a washing machine motor 140 which is mounted on a lower portion of the washing tub 120, to drive the washing tub 120 and the pulsator 130 simultaneously or selectively.

As shown in FIG. 2, the washing machine motor 140 includes: outer shafts 20 and 22 connected to the washing tub 120; inner shafts 30 and 32 rotatably disposed inside the outer shafts 20 and 22 and connected to the pulsator 130; an outer rotor 50 connected to the outer shafts 20 and 22; an inner rotor 40 connected to the inner shafts 30 and 32; and a stator 60 disposed between the inner rotor 40 and the outer rotor 50 with an air gap.

Any one of the inner shafts 30 and 32 and the outer shafts 20 and 22 may reduce the rotational speed and increase the torque.

In this embodiment, a planetary gear set 70 is provided in the inner shafts 30 and 32 to reduce the rotational speeds of the inner shafts 30 and 32 to increase the torque.

When the pulsator 130 is connected to the outer shafts 20 and 22, the planetary gear set 70 may be mounted on the outer shafts 20 and 22 to reduce the rotational speeds of the outer shafts 20 and 22.

The outer shafts 20 and 22 are formed in a cylindrical shape so that the inner shafts 30 and 32 pass through the outer shafts 20 and 22, respectively, and include a first outer shaft 20 coupled to the outer rotor 50, and a second outer shaft 22 coupled to the washing tub 120.

Then, the inner shafts 30 and 32 include a first inner shaft 30 coupled to the inner rotor 40 and a second inner shaft 32 coupled to the pulsator 130.

Figure 4:
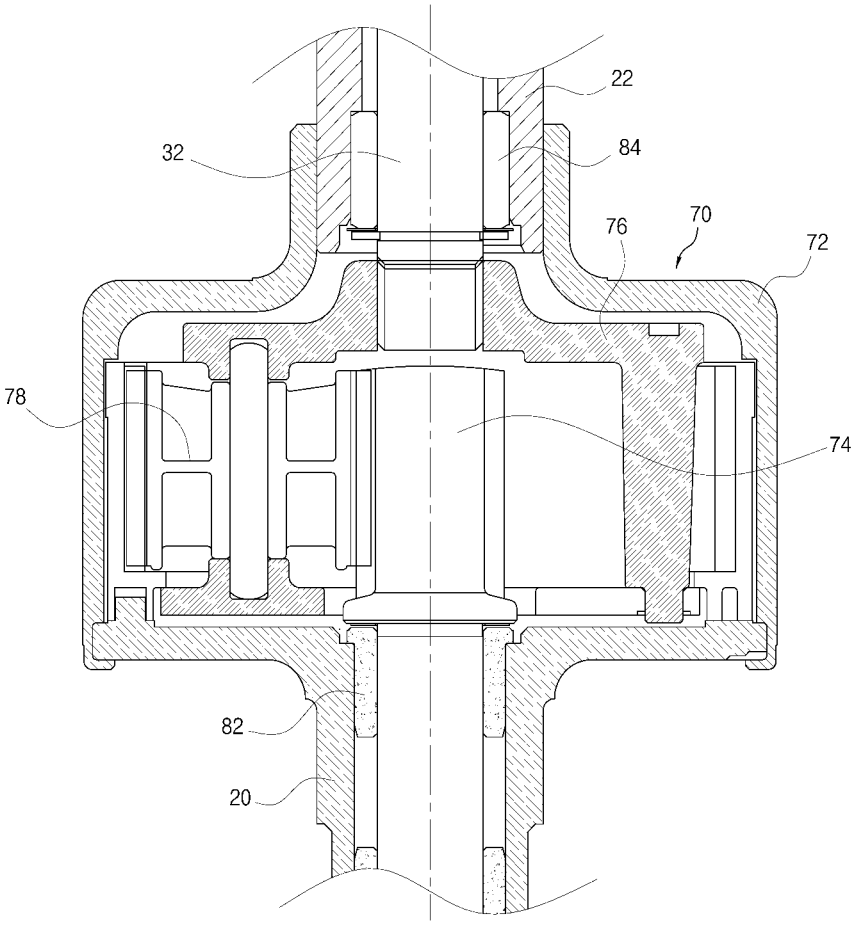
FIG. 4 is a cross-sectional view of the planetary gear set according to the first embodiment of the present invention.

As shown in FIG. 4, the planetary gear set 70 includes: a ring gear 72 connecting between the first outer shaft 20 and the second outer shaft 22; a sun gear 74 integrally coupled to the first inner shaft 30; a planetary gear 78 engaged with an outer surface of the sun gear 74 and an inner surface of the ring gear 72; and a carrier 76 to which the planetary gear 78 is rotatably supported and that is connected to the second inner shaft 32.

The planetary gear set 70 is configured so that the first outer shaft 20 and the second outer shaft 22 are connected by the ring gear 72 and thus the rotational speed of the first outer shaft 20 is transferred to the second outer shaft 22. Therefore, the rotational speed of the first outer shaft 20 is the same as that of the second outer shaft 22.

In addition, the first inner shaft 30 is formed integrally with the sun gear 74, and the second inner shaft 32 is spline-coupled with the carrier 76. The carrier 76 is rotatably supported in the center of the planetary gear 78. As a result, the rotational speed of the first inner shaft 30 is decelerated to then be transmitted to the second inner shaft 32.

In this way, the inner shafts 30 and 32 are interconnected via the planetary gear set 70 to thus decelerate the rotational speed of the inner rotor 40 to then be transmitted to the pulsator 130, to thereby increase the torque of the pulsator 130 and accordingly be applicable to a large-capacity washing machine.

A first sleeve bearing 80 and a second sleeve bearing 82 are respectively provided in a cylindrical form between an outer circumferential surface of the first inner shaft 30 and an inner circumferential surface of the first outer shaft 20, to thus rotatably support the first inner shaft 30.

A third sleeve bearing 84 and a fourth sleeve bearing 86 are provided on upper and lower inner surfaces of the second outer shaft 22, respectively, to thus rotatably support the second inner shaft 32.

A first link 90 to which an outer rotor support 56 of the outer rotor 50 is connected is formed on an outer surface of the first outer shaft 20 and a second link 92 to which an inner rotor support 46 of the inner rotor 40 is connected is formed on a lower end of the first inner shaft 30.

The first link 90 and the second link 92 may be serration-coupled or spline-coupled through protrusions formed on the outer surfaces of the first outer shaft 20 and the first inner shaft 30, or mutually key-coupled through key grooves formed on the outer surfaces of the first outer shaft 20 and the first inner shaft 30.

Here, a first locking nut 34 is screwed and coupled at the lower end of the first outer shaft 20, in which the first locking nut 34 prevents the departure of the outer rotor support 56 of the outer rotor 50 from the first outer shaft 20, and a second locking nut 36 is screwed and coupled at the lower end of the first inner shaft 30, in which the second locking nut 36 prevents the departure of the inner rotor support 46 of the inner rotor 50 from the first inner shaft 30.

A third link 94 is formed on the upper outer surface of the second outer shaft 22 in which the washing tub 120 is connected to the third link 94, and a fourth link 96 is formed on the upper outer surface of the second inner shaft 32 in which the pulsator 130 is connected to the fourth link 96.

The third link 94 and the fourth link 96 may be serration-coupled or spline-coupled through protrusions formed on the outer surfaces of the second outer shaft 22 and the second inner shaft 32, or mutually key-coupled through key grooves formed on the outer surfaces of the second outer shaft 22 and the second inner shaft 32.

A first seal 220 is mounted between the second outer shaft 22 and the second inner shaft 32 to prevent the washing water from leaking, and a second seal 210 is mounted between the second outer shaft 22 and a second bearing housing 10 to prevent the washing water from leaking.

A first bearing 26 is disposed on the outer surface of the first outer shaft 20, to thus rotatably support the first outer shaft 20 and a second bearing 28 is disposed on the outer surface of the second outer shaft 22, to thus rotatably support the second outer shaft 22.

The first bearing 26 is mounted in a first bearing housing 102 and the second bearing 28 is mounted in the second bearing housing 10.

The first bearing housing 102 is formed of a metallic material, and includes: a first bearing mount portion 104 in which the first bearing 26 is mounted; a cover portion 106 that is extended outwardly from the first bearing mount portion 104 to thus form a cylindrical shape, and that is disposed with a predetermined gap to wrap around the outer surface of the planetary gear set 70 to protect the planetary gear set 70; a flat plate portion 108 that is extended outwardly from the top of the cover portion 106 to thus form a circular plate, and to which the stator 60 and the outer tub 110 are fixed.

The flat plate portion 108 is coupled with the second bearing housing 10 with a plurality of bolts 250 in the circumferential direction of the flat plate portion 108.

The second bearing housing 10 is formed of a metallic material, and includes: a second bearing mount portion 12 in which the second bearing 28 is mounted; a second seal fastener 14 that is extended outwardly from the second bearing mount portion 12 to thus fasten the second seal 210; a link 16 that is bent downwardly from the second seal fastener 14 to thus form a cylindrical shape; and a flat plate portion 18 that is extended outwardly from a lower end of the link 16 to thus be fixed to the outer tub 110.

The flat plate portion 18 is coupled with the flat plate portion 108 of the first bearing housing 102 with bolts 250, and is fixed to a stator support 270 and the outer tub 110 with bolts 260.

Figure 5:
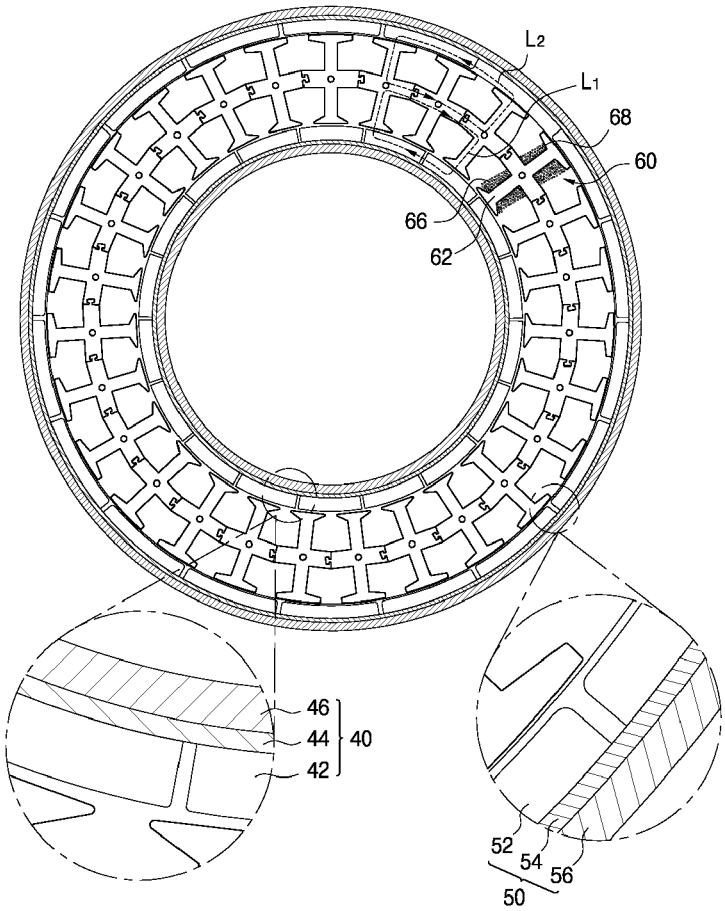
FIG. 5 is a transversal cross-sectional view of the washing machine motor according to the first embodiment of the present invention.

As shown in FIG. 5, the inner rotor 40 includes: a plurality of first magnets 42 that are disposed on the inner surface of the stator 60 with a certain gap; a first back yoke 44 disposed on the rear surfaces of the plurality of first magnets 42; and an inner rotor support 46 that is integrally formed with the first magnets 42 and the first back yoke 44 by an insert molding method.

Here, the inner rotor support 46 is integrally formed with the plurality of first magnets 42 and the first back yoke 44 by molding a thermosetting resin, for example, a BMC (Bulk Molding Compound) molding material such as polyester. Thus, the inner rotor 40 may have waterproof performance, and shorten the manufacturing process.

The inner surface of the inner rotor support 46 is connected to the second link 92 of the first inner shaft 30, and the first magnet 42 and the first back yoke 44 are fixed to the outer surface thereof.

Therefore, when the inner rotor 40 rotates, the inner shafts 30 and 32 are rotated, and the pulsator 130 that is connected to the inner shafts 30 and 32 is rotated.

Here, the pulsator 130 may be fully rotated by the torque of the inner rotor 40 due to the rotational torque that is not large.

Then, the outer rotor 50 includes: a plurality of second magnets 52 that are disposed on the outer surface of the stator 60 with a certain gap; a second back yoke 54 disposed on the rear surface of the plurality of the second magnets 52; and an outer rotor support 56 that is integrally formed with the second magnets 52 and the second back yoke 54 by an insert molding method.

Here, the outer rotor support 56 is integrally formed with the plurality of second magnets 52 and the second back yoke 54 by molding a thermosetting resin, for example, a BMC (Bulk Molding Compound) molding material such as polyester. Thus, the outer rotor 50 may have waterproof performance, and shorten the manufacturing process.

The inner surface of the outer rotor support 56 is connected to the first link 90 of the first outer shaft 20 and the outer rotor support 56 is rotated with the first outer shaft 20, and the second magnet 52 and the second back yoke 54 are fixed to the outer surface thereof.

Therefore, when the outer rotor 50 rotates, the outer shafts 20 and 22 are rotated, and the washing tub 120 associated with the outer shafts 20 and 22 is rotated.

Figure 3:
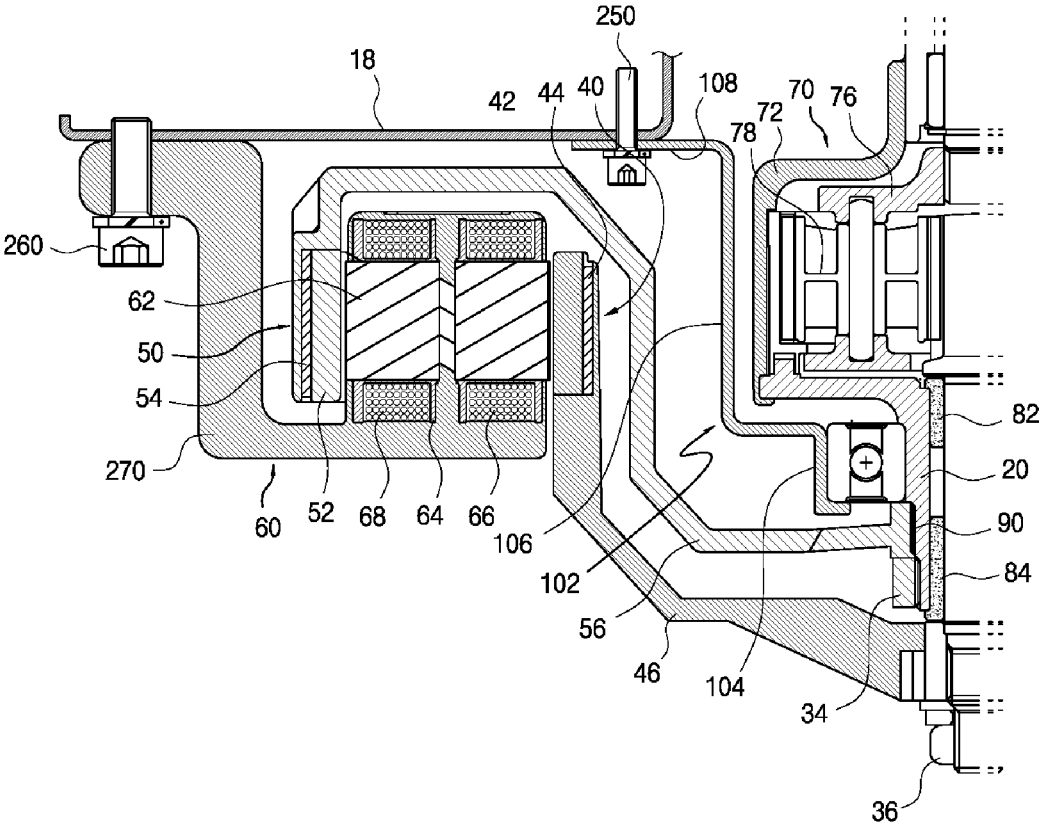
FIG. 3 is a partially enlarged cross-sectional view of the washing machine motor according to the first embodiment of the present invention shown in FIG. 2.
Figure 6:
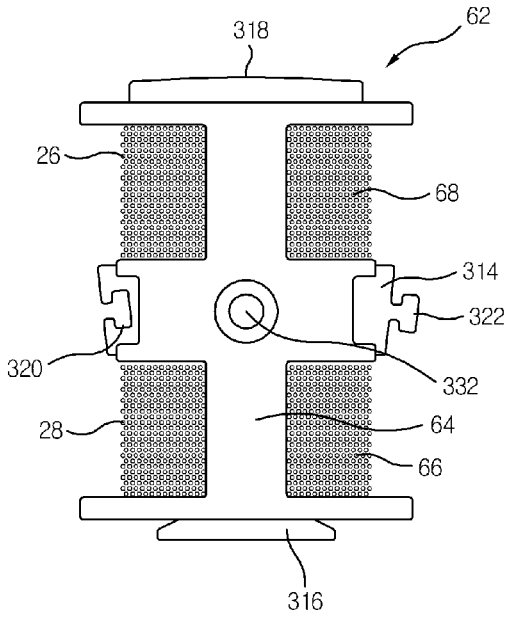
FIG. 6 is a cross-sectional view of a stator according to the first embodiment of the present invention.

As shown in FIGS. 3 and 6, the stator 60 includes: a plurality of split-type stator cores 62 that are arranged in an annular shape; non-magnetic bobbins 64 that are configured to wrap the outer circumferential surfaces of the plurality of stator cores 62, respectively; a first coil 66 that is wound on one side of each of the stator cores 62; a second coil 68 that is wound on the other side of each of the stator cores 62; and a stator support 270 in which the plurality of stator cores 62 are arranged in an annular shape and that is fixed to the outer tub 110.

The stator support 270 is integrally formed with the stator cores 62 by an insert molding method after arranging the plurality of stator cores 62 at certain intervals in an annular form in the circumferential direction thereof in a mold.

In other words, the stator support 270 is molded by the insert molding method by molding a thermosetting resin, for example, a BMC (Bulk Molding Compound) molding material such as polyester. In this case, the plurality of stator cores 62 are arranged at certain intervals in an annular form in the circumferential direction thereof in a mold, and thus are integrally formed.

Other than the structure that the stator support 270 is integrally formed with the stator cores 62 by insert molding, the stator support 270 may be separately manufactured from the stator cores 62 and then coupled with the stator cores 62 by using bolts.

Figure 7:
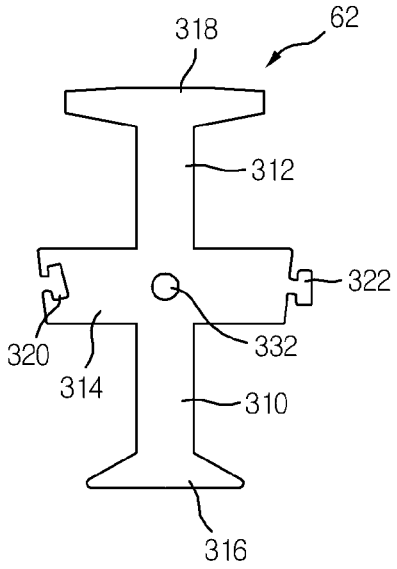
FIG. 7 is a cross-sectional view of a stator core according to the first embodiment of the present invention.

As shown in FIGS. 6 and 7, the stator core 62 includes: a first tooth portion 310 around which the first coil 66 is wound; a second tooth portion 312 that is formed on the other side of the first tooth portion 310 and around which the second coil 68 is wound; a partition 314 for partitioning between the first tooth portion 310 and the second tooth portion 312; and couplers 320 and 322 formed on both lateral ends of the partition 314 and interconnecting between the adjoining stator cores 62.

Here, a first drive signal is applied to the first coil 66 and a second derive signal is applied to the second coil 68. Accordingly, when the first drive signal is applied to only the first coil 66, only the inner rotor 40 is rotated, when the second drive signal is applied to only the second coil 68, only the outer rotor 50 is rotated, and when the first and second drive signals are applied to the first coil 66 and second coil 68, respectively, both the inner rotor 40 and outer rotor 50 are simultaneously rotated.

A throughhole 332 is formed at the center of the partition 314, to thus serve to prevent a first magnetic circuit formed by the first coil 66 and a second magnetic circuit formed by the second coil 68 from being interfered with each other. The throughhole 332 may be formed in a circular shape, but may be formed long in a slot type in the lateral direction of the partition 314.

A first flange 316 is formed at the end of the first tooth portion 310 so as to be disposed to face the first magnets 42 and a second flange 318 is formed at the end of the second tooth portion 312 so as to be disposed to face the second magnets 52.

The first flange 316 and the second flange 318 are formed to have inward and outward curved surfaces at predetermined curvatures, respectively, to correspond to the first magnet 42 of the inner rotor 40 and the second magnet 52 of the outer rotor 50. Thus, the roundness of the inner circumferential surface and the outer circumferential surface of the stator core 62 is increased and thus certain magnetic gaps may be maintained between the inner circumferential surface of the stator 60 and the first magnet 42 and between the outer circumferential surface of the stator 60 and the second magnet 52, respectively, although the inner circumferential surface and outer circumferential surface of the stator 60 are proximate to the first magnet 42 and the second magnet 52.

The stator cores 62 should have a structure of being directly connected to each other so as to form a magnetic circuit. Thus, the couplers 320 and 322 of one stator core 62 have a structure of being directly connected to the couplers 322 and 320 of another adjacent stator core 62 so that the stator cores 62 may be energized.

As an example, these couplers 320 and 322 are configured so that a coupling protrusion 322 is protrudingly formed at one side of the partition 314 and a coupling groove 320 with which a coupling protrusion 322 of a neighboring stator core 62 is fitted and coupled is formed at the other side of the partition 314. Thus, when the coupling protrusion 322 of one state core is fitted into and coupled with the coupling groove 320 of a neighboring stator core, the stator cores 62 are annularly arranged, and have a directly cross-linked structure that the stator cores 62 are directly connected with each other.

In addition to the above structure, the couplers have a structure that pinholes are formed at both end portions of the partition of each of the stator cores, and a pin member is fitted into and coupled with the pinholes of two stator cores at a state where the stator cores 62 contact each other, to thereby employ a structure of connecting between the stator cores. Alternatively, the couplers may employ a method of caulking the stator cores by using a caulking member in a state where the stator cores contact each other.

The washing machine motor according to an embodiment of the present invention forms a first magnetic circuit $L_1$ between the inner rotor 40 and one side of the stator 60 where the first coil 66 is wound, and forms a second magnetic circuit $L_2$ between the outer rotor 50 and the other side of the stator 60 where the second coil 68 is wound, to thus form a pair of magnetic circuits each independent to each other. As a result, the inner rotor 40 and the outer rotor 50 may be respectively driven separately.

More specifically, the first magnetic circuit $L_1$ includes the first magnet 42 of the N-pole, the first tooth portion 310 on which the first coil 66 is wound, an inner part of the partition 314, the adjacent first tooth portion 310, the first magnet 42 of the S-pole adjacent to the first magnet 42 of the N-pole, and the inner rotor support 46.

In addition, the second magnetic circuit $L_2$ includes the second magnet 52 of the N-pole, the second tooth portion 312 facing the second magnet 52 of the N-pole and on which the second coil 68 is wound, an outer part of the partition 314, the adjacent second tooth portion 312, the second magnet 52 of the S-pole, and the outer rotor support 56.

Figure 8:
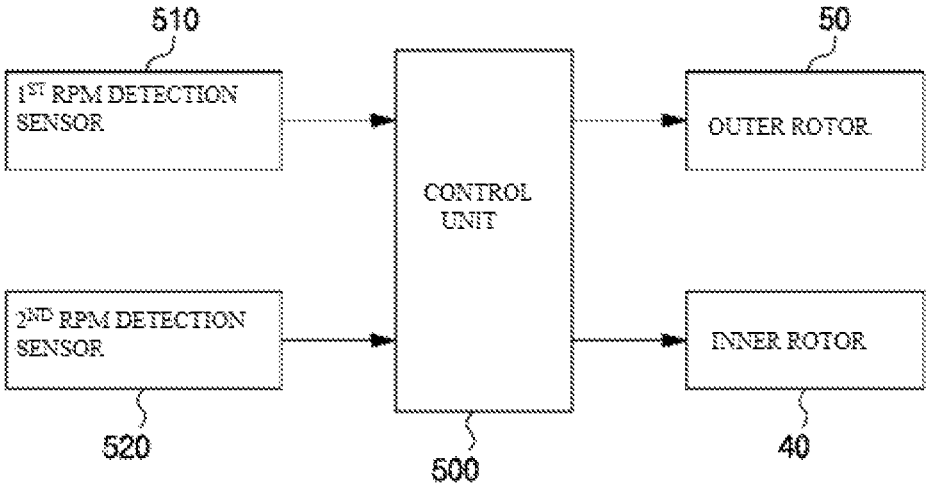
FIG. 8 is a block diagram of a washing machine control unit according to the first embodiment of the present invention.
Figure 9:
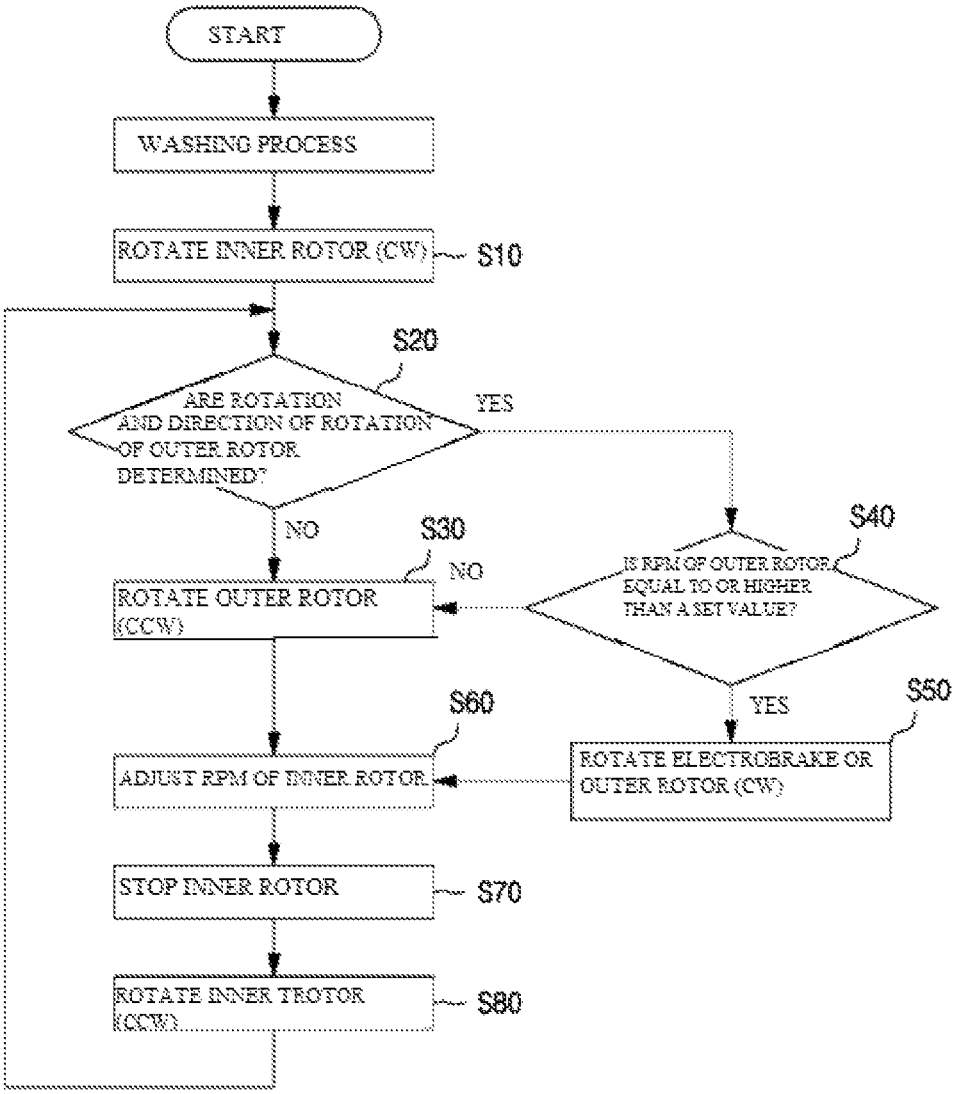
FIG. 9 is a flowchart illustrating a washing machine operating method according to the first embodiment of the present invention.

FIG. 8 is a block diagram of a washing machine control unit according to the first embodiment of the present invention, and FIG. 9 is a flowchart illustrating a washing machine operating method according to the first embodiment of the present invention.

The method of operating the washing machine according to the first embodiment will be described with respect to a method of implementing a dual-power during a washing operation of the washing machine.

First, in the washing process, the inner rotor is rotated in the clockwise (CW) direction (S10). That is, when a first drive signal is forwardly applied to the first coil 66, the inner rotor 40 is rotated clockwise (CW), and the first inner shaft 30 connected to the inner rotor 40 is rotated. The rotational speed is reduced by the planetary gear set 70 connected to the first inner shaft 30 to then be transmitted to the second inner shaft 32, and the pulsator 130 connected to the second inner shaft 32 is rotated clockwise (CW).

In this case, the ring gear 72 of the planetary gear set 70 is engaged with the outer shafts 20 and 22 and the washing tub 120 when the laundry is absent in the washing tub 120 or the laundry is less than a set value (when there is no load or less load on the pulsator 130) to thus perform a brake operation, and therefore the rotational force of the inner rotor 40 is input to the sun gear 74 and is output to the carrier 76. Thus, the pulsator 130 connected to the carrier 76 is rotated.

That is, when there is no laundry in the washing tub 120 or the laundry is less than the set value, the rotational force of the inner rotor 40 is transmitted to the pulsator 130 to rotate the pulsator 130.

When a certain amount of laundry is charged into the washing tub 120, the pulsator 130 is loaded, and the carrier 76 connected to the pulsator 130 acts as a brake. The rotational force of the inner rotor 40 is input to the sun gear 74 and is output to the ring gear 72 so that the washing tub 120 and the outer rotor 50 connected to the ring gear 72 rotate counterclockwise (CCW).

Then, the rotation and rotational direction of the outer rotor 50 are determined (S20). That is, according to a signal provided from a first RPM detection sensor 510 installed at one side of the outer rotor 50 and sensing the RPM of the outer rotor 50, a control unit 500 determines the rotation and the direction of rotation of the outer rotor 50.

Here, when the rotation of the outer rotor 50 is not sensed, the outer rotor 50 is rotated in the counterclockwise (CCW) direction (S30). That is, when the reverse second drive signal is applied to the second coil 68, the outer rotor 50 is rotated counterclockwise (CCW) and the washing tub 120 connected to the outer rotor 50 is rotated in the reverse direction.

When the rotation of the outer rotor 50 is detected, it is determined whether the RPM of the outer rotor 50 is equal to or higher than the set value (S40). That is, the control unit 500 compares the RPM of the outer rotor 50 with the set value according to the signal from the first RPM detection sensor 510, and determines whether the RPM of the outer rotor 50 is equal to or higher than the set value.

Here, when the RPM of the outer rotor 50 is less than the set value, the outer rotor 50 is rotated in the counterclockwise (CCW) direction, and when the RPM of the outer rotor 50 is equal to or higher than the set value, the electromagnetic brake is used or the outer rotor 50 is rotated in the clockwise (CW) direction to adjust the RPM of the outer rotor (S50).

Then, the outer rotor 50 acts as a brake, the rotational force of the inner rotor 40 is transmitted to the pulsator 130, and the pulsator 130 is rotated, to thereby perform the washing process.

Then, the RPM of the inner rotor 40 is adjusted (S60). That is, the control unit 500 detects the RPM of the outer rotor 50 according to the signal applied from the first RPM detection sensor 510, and detects the RPM of the inner rotor 40 according to a signal applied from a second RPM detection sensor 520, to thereby increase the rotational speed of the inner rotor 40 according to the RPM of the outer rotor 50, in which the second RPM detection sensor 520 is installed at one side of the inner rotor 40 and detects the RPM of the inner rotor 40. This is because when the outer rotor 50 is rotated, the reduction ratio of the planetary gear set 70 is changed to 5:1, 3:1 or 4:1. Therefore, in order to maintain the rotational speed of the pulsator 130, the RPM of the inner rotor 40 should be adjusted.

Then, in order to rotate the pulsator 130 in the reverse direction, the pulsator is stopped (S70). That is, when the braking action of the electromagnetic brake of the outer rotor 50 is released, the rotational force of the inner rotor 40 is transmitted to the washing tub 120, the washing tub 120 is rotated in the reverse direction, and the pulsator 130 is stopped. When the inner rotor 40 is stopped in this state, the inner rotor 40 is stopped in a state in which the load is low, so that the inner rotor 40 may be stopped with a relatively small power.

Then, the inner rotor 40 is rotated counterclockwise (CCW) to rotate the pulsator 130 in the reverse direction (S80).

Thereafter, while the process is re-progressed in the order described above, the pulsator 130 is rotated in the reverse direction for a predetermined time and then is stopped again to then be rotated in the forward direction for a predetermined time. Then, the pulsator 130 repeatedly performs the above process including the reverse rotation, stop and forward rotation.

Then, when the washing cycle is completed, a detangling cycle, a dewatering cycle, and the like are performed.

In the washing machine according to the present invention, as described above, if the laundry is introduced into the washing tub 120 and the load is loaded on the pulsator 130 when the inner rotor 40 is initially started, the rotational force of the inner rotor 40 is transmitted to the washing tub 120, and thus the inner rotor 40 is started in an almost no-load state. Therefore, the starting current may be lowered and thus the power consumption may be reduced.

In addition, in the washing machine of the present invention, the electromagnetic brake of the outer rotor 50 is released when the inner rotor 40 is stopped, and thus the pulsator 130 is stopped first, and then the inner rotor 40 is stopped. Thus, since the inner rotor 40 is stopped in a state in which the inertial moment is reduced, an end current may be lowered, thereby reducing the power consumption.

Figure 10:
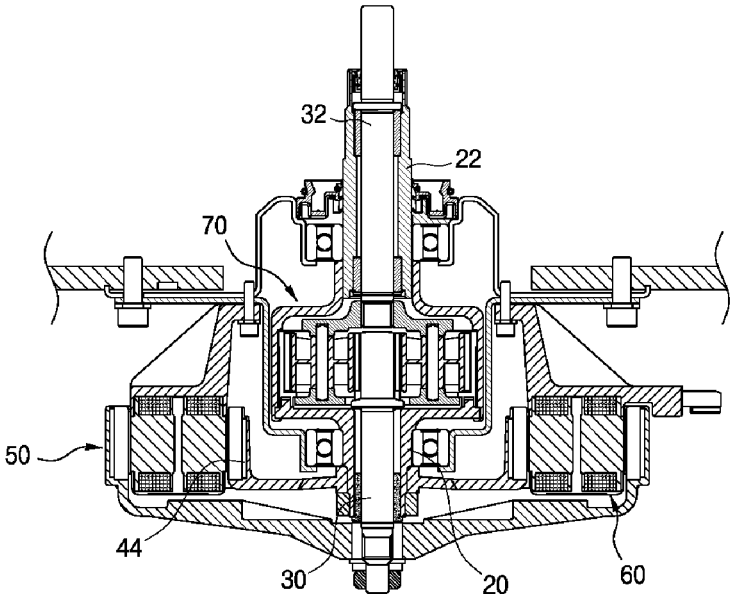
FIG. 10 is a cross-sectional view of a washing machine motor according to a second embodiment of the present invention.

FIG. 10 is a cross-sectional view of a washing machine motor according to a second embodiment of the present invention.

The washing machine motor according to the second embodiment includes: outer shafts 20 and 22 connected to a washing tub 120; inner shafts 30 and 32 rotatably disposed inside the outer shafts 20 and 22 and connected to the pulsator 130; an inner rotor 40 connected to the outer shafts 20 and 22; an outer rotor 50 connected to the inner shafts 30 and 32, a stator 60 disposed with a gap between the inner rotor 40 and the outer rotor 50; and a planetary gear set 70 disposed on the inner shafts 30 and 32 to reduce the rotational speeds of the inner shafts 30 and 32, to thereby increase the torque thereof.

The washing machine according to the second embodiment as described above, is the same as the washing machine motor according to the first embodiment described above. However, in the washing machine according to the first embodiment, the pulsator 130 and the inner rotor 40 are connected to each other by the planetary gear set 70 and the washing tub 120 and the outer rotor 50 are connected to each other by the planetary gear set 70, while, in the washing machine motor according to the second embodiment, the washing tub 120 and the inner rotor 40 are connected to each other by the planetary gear set 70, and the pulsator 130 and the outer rotor 50 are connected to each other by the planetary gear set 70.

The method of operating the washing machine according to the second embodiment is the same as that of the first embodiment described above. However, in the washing machine operating method according to the first embodiment, the rotational force of the inner rotor 40 is transmitted to the pulsator 130 and the rotational force of the outer rotor 50 is transmitted to the washing tub 120, while, in the washing machine operating method according to the second embodiment, the rotational force of the outer rotor is transmitted to the pulsator 130 and the rotational force of the inner rotor 40 is transmitted to the washing tub 120.

While the present invention has been particularly shown and described with reference to the preferred embodiments thereof, it is to be understood that the invention is not limited to the disclosed embodiments, but, on the contrary, various changes and modifications may be made by those skilled in the art.

INDUSTRIAL APPLICABILITY

The present invention can be applied to a washing machine capable of independently driving a pulsator and a washing tub and capable of realizing a dual-power and forming various water flow patterns.

The invention claimed is:

1. A washing machine comprising:

an inner rotor;

an outer rotor;

a stator disposed with an air gap between the inner rotor and the outer rotor and having a plurality of stator cores arranged in an annular form, wherein each of the stator cores includes a first tooth portion faced with the inner rotor and wound with a first coil, and a second tooth portion faced with the outer rotor and wound with a second coil, so that the inner rotor and the outer rotor are driven selectively and independently from each other;

a first outer shaft connected to the outer rotor;

a second outer shaft connected to a washing tub;

a first inner shaft connected to the inner rotor;

a second inner shaft connected to a pulsator disposed inside the washing tub;

a planetary gear set comprising: a ring gear fixedly coupled to the first outer shaft and the second outer shaft; a sun gear fixedly coupled to the first inner shaft; a plurality of planetary gears rotatably engaged with an outer surface of the sun gear and an inner surface of the ring gear; and a carrier coupled to the second inner shaft and rotatably supporting the planetary gears, and a control unit configured to control the inner rotor and the outer rotor selectively and independently from each other, wherein the planetary gear set is configured in such a way that, when a rotational force from the inner rotor is applied to the sun gear through the first inner shaft, a rotational speed of the inner rotor is decelerated through the planetary gears and is transmitted to the pulsator through the carrier and the second inner shaft; and, when a rotational force from the outer rotor is applied to the ring gear through the first outer shaft, a rotational speed of the outer rotor is not decelerated and is transmitted to the washing tub through the ring gear and the second outer shaft, and wherein, at a time of initially starting the pulsator, the control unit is configured to release the outer rotor to make the washing tub in an idle state, and the planetary gear set is configured in such a way that the rotational force of the inner rotor is transmitted to the washing tub through the plurality of planetary gears, the ring gear and the second outer shaft to drive the washing tub in opposite direction to that of the inner rotor, thereby being able to lower an electric current required for initially starting the inner rotor when a load is applied to the pulsator by a laundry inside the washing tub.

2. The washing machine according to claim 1, wherein, at a time of stopping the pulsator, the control unit is configured to release the outer rotor to make the washing tub in an idle state so that an inertial moment of the pulsator is transmitted to the ring gear through the sun gear, and then the washing tub rotates in opposite direction to that of the pulsator, thereby being able to reduce a stopping electric current required for stopping the inner rotor.

* * * * *